United States Patent [19]

Alexander et al.

[11] 4,111,398

[45] Sep. 5, 1978

[54] HAULAGE WINCHES

[75] Inventors: William Alexander, Elstree; John T. H. Webb, Sunningdale, both of England

[73] Assignee: Wharton Engineers (Elstree) Limited, United Kingdom

[21] Appl. No.: 758,410

[22] Filed: Jan. 11, 1977

Related U.S. Application Data

[63] Continuation of Ser. No. 569,394, Apr. 18, 1975, abandoned.

[51] Int. Cl.[2] ..... B66D 1/76

[52] U.S. Cl. ..... 254/175.5; 242/54 R

[58] Field of Search ..... 254/175.3, 175.7, 175.5, 254/184, 150 R, 190 R; 114/235 R; 226/118; 242/155, 83, 54 R

[56] References Cited

U.S. PATENT DOCUMENTS

| | | | |
|---|---|---|---|
| 2,961,216 | 11/1960 | Blair | 254/175.7 |
| 3,103,345 | 9/1963 | Eitel | 254/190 R |
| 3,300,187 | 1/1967 | Saxe et al. | 254/175.7 |
| 3,776,519 | 12/1973 | Hamilton | 254/175.5 |
| 3,834,673 | 9/1974 | Alexander | 254/150 R |
| 3,912,228 | 10/1975 | Petty et al. | 254/175.7 |
| 3,917,229 | 11/1975 | Ayme | 254/175.5 |

*Primary Examiner*—Trygve M. Blix
*Assistant Examiner*—Kenneth Noland
*Attorney, Agent, or Firm*—Arnold, White & Durkee

[57] ABSTRACT

There is provided a winch which comprises at least one, preferably twin, haulage drums, at least one haulage wheel for delivering cable to the drum, and drive mechanism for rotating the haulage drum and the haulage wheel. Advantageously, the winch comprises twin haulage drums, a chain of gears for driving the haulage drums, the majority of the gears being mounted on shafts which lie substantially in a substantially horizontal plane passing substantially through the axes of the haulage drums, at least one haulage wheel for delivering cable to the twin haulage drums, and drive mechanism for rotating the twin haulage drums and the haulage wheel.

9 Claims, 2 Drawing Figures

HAULAGE WINCHES

Figure 2:
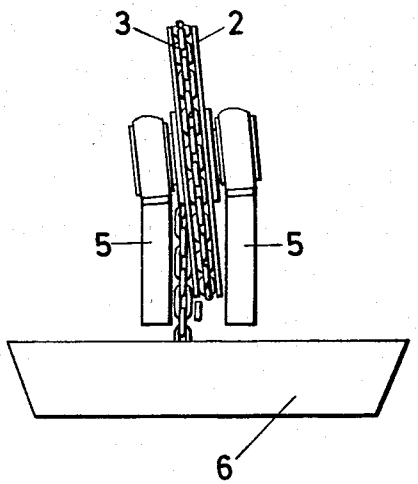

This is a continuation of application Ser. No. 569,394, filed Apr. 18, 1975 now abandoned.

This invention relates to a haulage winch.

U.S. Pat. No. 3,834,673 describes a haulage winch comprising twin haulage drums having multiple grooves, and a chain of gears for driving the haulage drums, the majority of the gears being mounted on shafts which lie in or adjacent a substantially horizontal plane in which the axes of the haulage drums lie.

High bending and compressive stress can occur in the bearings and mountings of the haulage drums of such a winch. This invention aims to reduce such stress to enable the size of components in the drum section of the winch having twin haulage drums, and the power supply requirements to drive the twin haulage drums, to be reduced for a given load.

It is an object of the present invention to provide a winch comprising at least one, preferably twin, haulage drum and at least one haulage wheel for delivering cable to the drum.

It is a further object of the present invention to provide a method of hauling a cable, which method comprises hauling the cable by means of a winch comprising at least one, preferably twin, haulage drums, and at least one haulage wheel over which the cable passes to the haulage drum.

It is yet another object of the present invention to provide a winch comprising twin haulage drums, a chain of gears for driving the haulage drums, the majority of the gears being mounted on shafts which lie in or adjacent a substantially horizontal plane passing substantially through the axes of the haulage drums, at least one haulage wheel for delivering cable to the twin haulage drums, and drive means for rotating the twin haulage drums and the haulage wheel.

Herein, the word "cable" includes steel cored ropes and fibre cored ropes.

The haulage wheel reduces the stresses which occur, for a given load, in the bearings and mountings of the haulage drum(s) and thus the size of components in the drum section of the winch and the power supply requirements to drive the drum(s) can be reduced.

Preferably, the haulage wheel has a larger diameter than the or each haulage drum.

The breaking strength of a cable is a function of the load on the cable and the bend radius applied to the cable on a sheave. By using a haulage wheel of large diameter, the cable has a large initial bend radius when the load on the cable is at a maximum and this enables a smaller diameter haulage drum or drums to be used without overstressing the cable. Furthermore, the internal cable stress is less due to the large initial bend radius and this results in a longer cable life.

The winch may also comprise a storage drum, which is rotated by the drive means, for storing, at low tension, cable delivered thereto from the haulage drum(s).

The winch may be adapted for hauling cable and chain in sequence. To this end, the haulage wheel may comprise a chain wheel adapted to accommodate both cable and chain. In this case, the winch preferably comprises means adapted to cut off the drive to the haulage drum(s) and the storage drum, but not the drive to the haulage wheel, before any chain being hauled reaches the haulage drum(s) whereby the chain is delivered to storage means disposed below the haulage wheel. Alternatively, the haulage drum(s) may continue to be rotated by the drive means; since the load is borne almost entirely by the chain wheel as the leading end of the chain approaches the haulage drum(s), the tension of the cable on the haulage drum(s) is low and thus the drum(s) can slip relative to the cable thereof whilst the chain is delivered to storage means disposed below the haulage wheel.

In the case of a twin drum haulage winch in accordance with the third aspect of the present invention, the twin drum section of the winch, the storage drum and the drive mechanisms for the twin haulage drums and the storage drum may be substantially as shown in the drawings of U.S. Pat. No. 3,834,673. In this case, the winch comprises a chain of reduction gears and at least one bevel gear, whereby the axis of rotation of the twin haulage drums is at right angles to the axis of rotation of the power input shaft. The gears are housed in a generally L-shaped gear box having a longer part extending parallel to the power input shaft and a shorter part extending at right angles to the longer part, the power input shaft extending through one wall of a casing of the shorter part of the gear box. The shorter gear box part includes a number of spur gears and includes provision for selecting forward drive of the twin haulage drums.

Each haulage drum is rotatable on a respective shaft to which a spur gear is attached and a main drive shaft lies between the shafts of the twin haulage drums and carries a spur gear in driving contact with both the spur gears on the shafts of the haulage drums. The main drive shaft also has a crown wheel of a bevel gear secured thereto.

The shafts of the twin haulage drums, the main drive shaft and the crown wheel are all located in the longer gear box part, and a connecting shaft connects the shorter and longer gear box parts. One end of the connecting shaft lies within the shorter gear box part and has a spur gear fixedly mounted thereon, and the other end of the connecting shaft has a bevel pinion gear fixedly mounted thereon, the bevel pinion gear meshing with the crown wheel.

The storage drum is driven from the gear box via a friction coupling the gearing being such that but for relative movement, that is slipping of the parts of the friction coupling, the storage drum would be driven to reel in cable during pulling of a load at a higher speed than the cable is reeled in by rotation of the haulage drums.

The storage drum drive mechanism locks during paying out of cable from the drum so that the entire rotational movement of the drum during paying out of cable occurs by slipping of the friction coupling. The storage drum drive mechanism includes a shaft having mounted thereof a chain wheel including a free wheel device which locks to drive the chain wheel when the shaft rotates in a direction consistent with the reeling in of cable, but which free wheels allowing the wheel to remain stationary when the shaft rotates in a reverse direction consistent with reeling out of cable.

The chain wheel which includes a free wheel device is drivingly connected to a second chain wheel rotatable with a shaft which in turn is rotatable with a friction plate arranged in frictional driving contact with the storage drum. The shaft to which the friction plate is secured is connected with a free wheel device which prevents the shaft from rotating in a direction consistent with paying out of the cable from the storage drum whereby such rotation of the drum occurs by slipping of the friction coupling.

In winches to be used for hauling very heavy loads, it is preferred not to include a bevel gear in the gear box for driving the twin haulage drums. In this case, the gear box preferably comprises only spur gears having parallel shafts which lie adjacent a substantially horizontal plane in which the axes of the twin haulage drums lie. The spur gears may or may not be chain driven.

The haulage wheel may be chain driven either from the input shaft to the gear box, or independently from a motor, such as a hydraulic motor, other than that used to drive the input shaft.

On ships and oil well drilling rigs it is advantageous to store the cable apart from the haulage winch. To this end, the cable storage drum may be located remote from the haulage winch in which case a separate drive, such as an hydraulic or electric motor, will be required for the storage drum.

Figure 1:
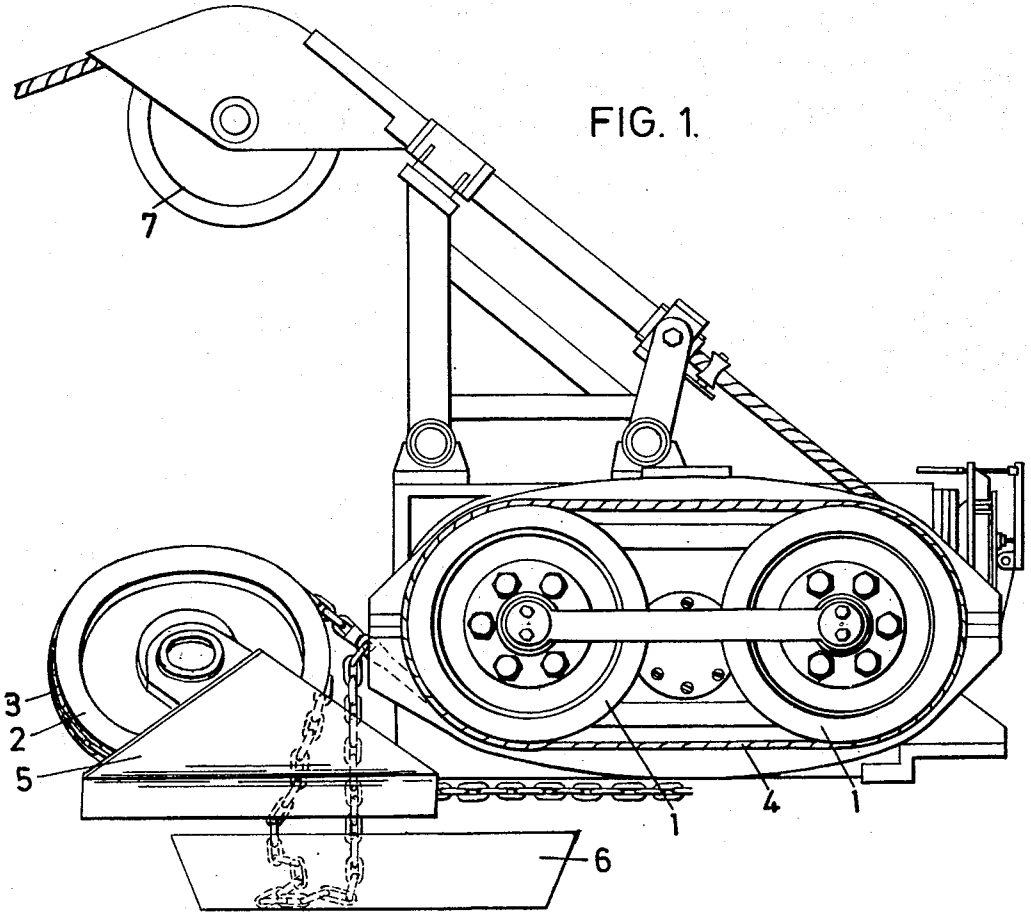

For a better understanding of the present invention and to show how the same may be carried into effect reference will now be made, by way of example, to the accompanying drawings in which:

FIG. 1 shows a side elevation of a twin drum haulage winch for handling cable and chain in sequence, and FIG. 2 shows a front view of part of the haulage winch of FIG. 1.

The winch comprises twin multi-spool haulage drums 1 having substantially parallel, horizontal rotational axes. A haulage wheel 2 adapted to accommodate both chain 3 and cable 4, and having a larger diameter than that of the haulage drums 1, is arranged for delivering cable to the haulage drums 1. The haulage wheel 2 is disposed substantially at the level of a horizontal plane containing the rotational axes of the haulage drums 1, and the rotational axis of the haulage wheel 2 is slightly inclined to the horizontal. The haulage line is delivered to the haulage wheel 2 on one side of the horizontal plane containing the rotational axes of the haulage drums 1; passes around the haulage wheel 2 and disengages from the haulage wheel 2 on the other side of the plane; and engages the twin haulage drums on the one side of the plane. As shown in FIG. 1, the line from the haulage wheel 2 unimpededly passes directly to the haulage drums 1.

Guide plates 5 are connected to axle housings of the haulage wheel 2. The guide plates 5 extend substantially parallel to one another on either side of the wheel 2, to a position below the lowest portion or the wheel 2. The guide plates 5 are intended to guide chain 3 delivered from the haulage wheel 2 to a chain collecting locker 6 disposed beneath the guide plates.

An automatic spooling device 7 for feeding cable from the haulage drums 1 to a storage drum (not shown) is disposed above the haulage wheel 2.

Any of the alternative mechanisms described hereinbefore may be provided for driving the haulage drums 1, the storage drum and the haulage wheel 2. The drawings of U.S. Pat. No. 3,834,673 should be referred to for details of these mechanisms.

A tripping device (not shown) is disposed between the haulage wheel and the first of the haulage drums 1 to which cable 4 is delivered from the haulage wheel 2. When activated, the tripping device cuts off the drive to the storage drum and the haulage drums 1, but not the haulage wheel 2.

In operation of the winch for raising, for example, an anchor attached to an anchor chain which is connected to a cable, the cable is hauled in first and passes under and around the haulage wheel 2 to the top of the wheel. From the top of the haulage wheel 2 the cable passes downwardly under the twin haulage drums 1 and extends around the drums 1, several times, in the grooves thereof. The cable then passes upwardly from the haulage drums 1 to the automatic spooling device 7 which feeds the cable to the storage drum.

Eventually the chain reaches the haulage wheel 2. When the chain first passes over the wheel 2 it strikes an obstruction of the tripping device which causes the drive to the storage drum and the haulage drums 1 to be stopped. However, the haulage wheel 2 continues to rotate and the chain passes over the haulage wheel 2 and falls into the storage locker 6. Owing to the slight inclination of the axis of the haulage wheel 2 to the horizontal, the part of the chain which falls into the locker 6 does not interfere with the part of the chain which is being delivered to the haulage wheel 2.

A winch in accordance with the present invention has the advantage that the bearing loads, on the twin haulage drums are reduced due to the haulage wheel. This enables the size of the components in the twin drum section, and the power supply requirements therefore, to be reduced for a winch having a given maximum load, as compared with a winch comprising twin haulage drums but no haulage wheel.

The use of a leading haulage wheel of large diameter has the advantage that the pressure between the cable and the wheel, during hauling, can be maintained at a low level. This enables the winch to be used for hauling relatively inexpensive cables. There is also the possibility of using very high strength plastics material cables currently being developed which, when subjected to high compressive stresses on drum winches of the standard type, are destroyed by being stored on the drum at very high pressure.

We claim:

1. A multi-capstan winch for hauling in under load a cable, comprising at least first, second, and third rotatably driven capstans, the second and third capstans being of reduced diameters, the first capstan being of an enlarged diameter and driven for delivering the cable under load to the second and third capstans, the second and third capstans of a configuration to receive a plurality of wraps of the hauling cable, and the first capstan positioned with respect to the second and third capstan to receive more than a one-half wrap of the hauling cable.

2. The multi-capstan winch according to claim 1 wherein the hauling cable unimpededly runs directly from the first capstan to the second capstan.

3. The multi-capstan winch according to claim 2 wherein said second and third capstans have coplaner axes and the axis of said first capstan is tilted with respect to the axes of the other capstans.

4. The multi-capstan winch according to claim 3 wherein the axis of the first capstan is fixed at said tilt with respect to the axes of the other capstans.

5. The multi-capstan winch according to claim 1 wherein said second and third capstans have coplanar axes and are positioned to enable the hauling cable to approach the first capstan on one side of said axial plane, to leave the first capstan on the other side of said capstan plane, and to approach said second capstan on said one side of said plane.

6. In a multi-capstan winch having at least three driven capstans for hauling in a cable, two of the capstans having co-planar axes, the third capstan being larger in diameter than the other capstans and positioned for delivering the cable at a reduced load to said two capstans, the improvement wherein said two capstans are configured to receive a plurality of wraps of the cable and to unimpededly receive the cable directly from said third capstan such that the cable approaches said third capstan on one side of said axial plane, leaves the third capstan on the other side of said plane, and approaches one of said two capstans on said one side of said plane.

7. The multi-capstan winch according to claim 6 wherein said third capstan is a single groove capstan.

8. A method of hauling cable under load using a double capstan winch having first and second driven capstans with coplanar axes, comprising the steps of:

passing the cable around a third driven capstan, which is larger in diameter than the first and second driven capstans, the cable approaching said third capstan on one side of said axial plane and leaving the third capstan on the other side of said plane;

unimpededly passing the cable from the third capstan directly to the double capstan winch, whereby the cable approaches the double capstan winch on said one side of the axial plane; and driving the third capstan to deliver cable under load to the double capstan winch, whereby the double capstan winch receives the cable with reduced loading.

9. A multi-capstan winch comprising:

(a) at least first and second driven capstans of relatively smaller drum diameters and having axes lying substantially in a plane, said first and second capstans essentially defining a twin capstan winch; and (b) a third driven capstan of a relatively larger drum diameter and disposed in association with the first and second capstans for delivering a cable under load to either the first or second capstan, whereby said third capstan is rotatable about an axis which is substantially at the level of the rotational axes of the first and second capstans and is disposed to unimpededly deliver the cable directly to the twin capstan winch such that the cable approaches the third capstan on one side of said plane, leaves the third capstan on the other side of said plane, and approaches one of the first or second capstans on said one side of the plane.

* * * * *